US009622633B2

(12) United States Patent
Kim et al.

(10) Patent No.: US 9,622,633 B2
(45) Date of Patent: Apr. 18, 2017

(54) ROBOT CLEANER

(71) Applicant: LG ELECTRONICS INC., Seoul (KR)

(72) Inventors: Jongsu Kim, Seoul (KR); Hwang Kim, Seoul (KR); Sungil Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/952,760

(22) Filed: Nov. 25, 2015

(65) Prior Publication Data

US 2016/0143499 A1 May 26, 2016

(30) Foreign Application Priority Data

Nov. 16, 2014 (KR) ..... 10-2014-0166707
Nov. 26, 2014 (KR) ..... 10-2014-0166701

(51) Int. Cl.
*A47L 9/10* (2006.01)
*A47L 9/28* (2006.01)
(Continued)

(52) U.S. Cl.
CPC ..... *A47L 9/2852* (2013.01); *A47L 5/22* (2013.01); *A47L 9/009* (2013.01); *A47L 9/0081* (2013.01);
(Continued)

(58) Field of Classification Search
CPC ..... A47L 5/22; A47L 9/16; A47L 9/22; A47L 9/0081; A47L 9/1608; A47L 9/161;
(Continued)

(56) References Cited

U.S. PATENT DOCUMENTS 8,220,104 B1 7/2012 Chu
2009/0229074 A1* 9/2009 Oh ..... A47L 9/1641 15/353
(Continued)

FOREIGN PATENT DOCUMENTS

JP H08-280592 10/1996
JP 2002-298929 10/2002
(Continued)

OTHER PUBLICATIONS

European Search Report dated Apr. 15, 2016 issued in Application No. 15195685.1.
(Continued)

*Primary Examiner* — David Redding
(74) *Attorney, Agent, or Firm* — KED & Associates, LLP

(57) ABSTRACT

A cleaner body forms an outer appearance of a robot cleaner. A suction module provided in the cleaner body, and configured to suck dust on a surface to be cleaned. A first guiding member and a second guiding member communicate with the suction module, and spaced apart from each other, and a cyclone unit is configured to separate dust from air sucked through the first and second guiding members, using a centrifugal force. A fan module is connected to the cyclone module, and includes a motor module, and a first fan module and a second fan module connected to two sides of the motor module and configured to generate a suction force. A noise reducing cover is provided over an upper side of the fan module so as to reduce noise, and extends toward two sides of the motor module to cover the first and second fan modules.

20 Claims, 10 Drawing Sheets

(51) Int. Cl.

| | |
|---|---|
| ***A47L 9/00*** | (2006.01) |
| ***A47L 9/22*** | (2006.01) |
| ***A47L 5/22*** | (2006.01) |
| *A47L 9/16* | (2006.01) |

(52) U.S. Cl.
CPC ..... *A47L 9/16* (2013.01); *A47L 9/1608* (2013.01); *A47L 9/1616* (2013.01); *A47L 9/1641* (2013.01); *A47L 9/22* (2013.01); *A47L 9/1625* (2013.01); *A47L 9/1633* (2013.01); *A47L 2201/00* (2013.01); *A47L 2201/04* (2013.01)

(58) Field of Classification Search
CPC .... A47L 9/1625; A47L 9/1633; A47L 9/1641; A47L 2201/00
See application file for complete search history.

(56) References Cited

U.S. PATENT DOCUMENTS

| | | | | |
|---|---|---|---|---|
| 2010/0263161 | A1* | 10/2010 | Lee | A47L 5/362 15/347 |
| 2011/0162157 | A1 | 7/2011 | Dooley et al. | |
| 2011/0202175 | A1 | 8/2011 | Romanov et al. | |
| 2012/0167917 | A1 | 7/2012 | Gilbert, Jr. | |
| 2014/0130290 | A1 | 5/2014 | Jang et al. | |
| 2014/0182627 | A1 | 7/2014 | Williams et al. | |

FOREIGN PATENT DOCUMENTS

| | | | |
|---|---|---|---|
| JP | 2006-231028 | | 9/2006 |
| JP | 2007-520323 | | 7/2007 |
| KR | 10-2007-0064997 | A | 6/2007 |
| KR | 10-0809773 | B1 | 3/2008 |
| KR | 2008-0022342 | | 3/2008 |
| KR | 10-2010-0108839 | A | 10/2010 |
| KR | 10-0996531 | B1 | 11/2010 |
| KR | 10-10309796 | B1 | 9/2013 |
| WO | WO 2011/074716 | A1 | 6/2011 |
| WO | WO 2013/171462 | A2 | 11/2013 |

OTHER PUBLICATIONS

European Search Report dated May 13, 2015 issued in Application No. 15195696.8.
Korean Office Action dated Oct. 30, 2015 issued in Application No. 10-2014-0169996.
U.S. Appl. No. 14/955,940, filed Dec. 1, 2015, David A. Redding.
U.S. Appl. No. 14/956,205, filed Dec. 1, 2015, Stephanie R. Berry.
Japanese Office Action dated Oct. 21, 2016 issued in Application No. 2015-235432.
United States Notice of Allowance dated Jan. 5, 2017 issued in U.S. Appl. No. 14/955,940.

* cited by examiner

ROBOT CLEANER

CROSS-REFERENCE TO RELATED APPLICATION(S)

Pursuant to 35 U.S.C. §119(a), this application claims the benefit of earlier filing date and right of priority to Korean Application Nos. 10-2014-0166701, filed on Nov. 26, 2014, and Korean Application No. 10-2014-0166707, filed on Nov. 26, 2014, the contents of which is incorporated by reference herein in its entirety.

BACKGROUND

1. Field

The present disclosure relates to a robot cleaner.

2. Background

Generally, a robot has been developed for an industrial use, and has managed some parts of factory automation. As the robot is applied to various fields recently, not only medical robots and space robots, but also home robots are being developed. A representative of the home robot is a robot cleaner, a kind of home electronic appliance capable of performing a cleaning operation by sucking dust on a floor (including foreign materials) while autonomously moving on a predetermined region. Such robot cleaner is provided with a chargeable battery, and is provided with an obstacle sensor for avoiding an obstacle while moving.

The robot cleaner is configured to suck dust-contained air, to filter dust from the dust-contained air by a filter, and to discharge dust-filtered air to the outside. A fan rotated by driving of a motor generates a suction force which forms such a flow. As the motor and the fan are driven, vibrations and noise occur from the robot cleaner. Further, when a suction force is increased for enhanced performance, vibrations and noise are also increased.

e

BRIEF DESCRIPTION OF THE DRAWINGS

The embodiments will be described in detail with reference to the following drawings in which like reference numerals refer to like elements wherein.

DETAILED DESCRIPTION

Figure 1:
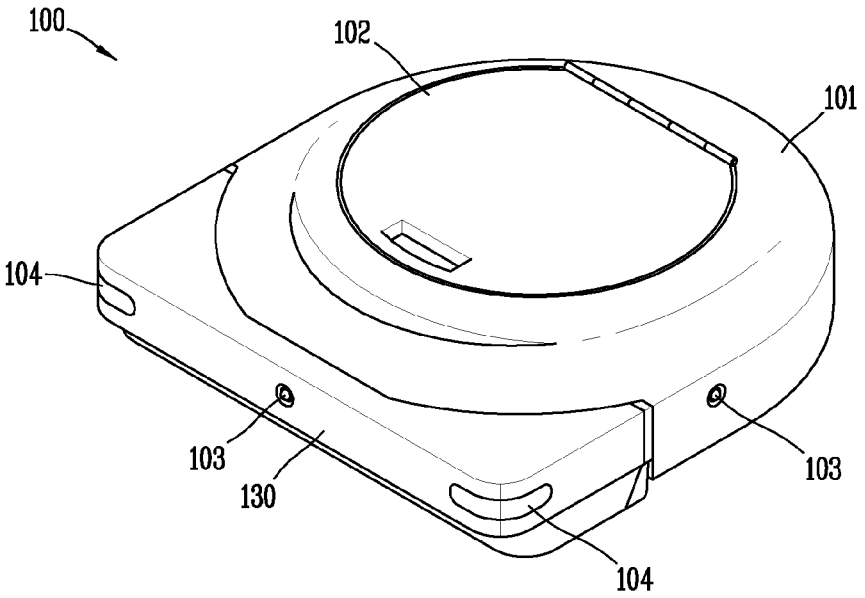
FIG. 1 is a perspective view of a robot cleaner according to the present disclosure.
Figure 2:
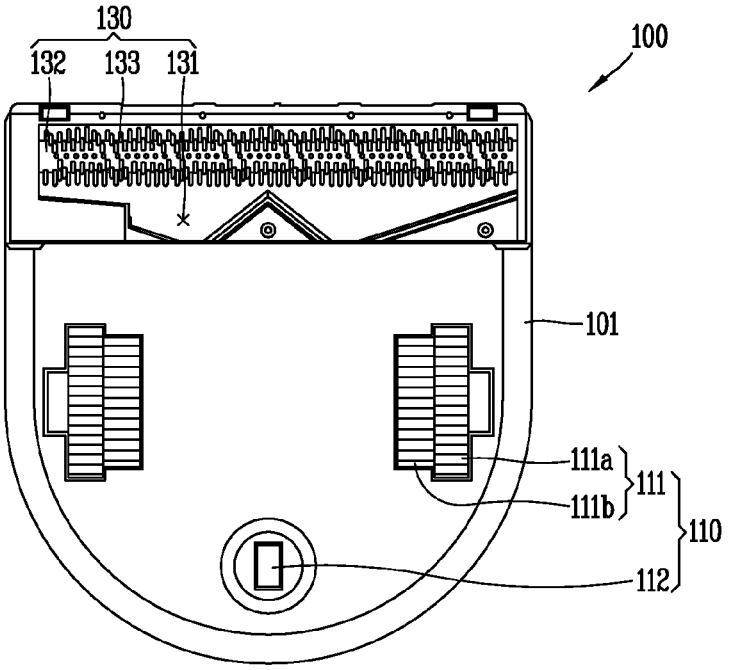
FIG. 2 is a bottom view of the robot cleaner of FIG. 1.

Referring to FIGS. 1 and 2, the robot cleaner 100 performs a function to clean a floor by sucking dust (including foreign materials) on the floor, while autonomously moving on a predetermined region. The robot cleaner 100 includes a cleaner body 101 for performing a moving function, a controller (not shown) and a moving unit 110, e.g., a motorized wheel. The cleaner body 101 is configured to accommodate components therein, and to move on a floor by the moving unit 110. The controller for controlling an operation of the robot cleaner 100, a battery (not shown) for supplying power to the robot cleaner 100, etc. may be mounted to the cleaner body 101.

The moving unit 110 is configured to move (or rotate) the cleaner body 101 back and forth or right and left, and is provided with main wheels 111 and a supplementary wheel 112. The main wheels 111 are provided at two sides of the cleaner body 101, are configured to be rotatable to one direction or another direction according to a control signal. The main wheels 111 may be configured to be independently driven. For instance, each of the main wheels 111 may be driven by a different motor.

Each of the main wheels 111 may be composed of wheels 111*a* and 111*b* having different radiuses with respect to a rotation shaft. Under such a configuration, in a case where the main wheel 111 moves up on an obstacle such as a bump, at least one of the wheels 111*a* and 111*b* contacts the obstacle. This can prevent idling of the main wheel 111. The supplementary wheel 112 is configured to support the cleaner body 101 together with the main wheels 111, and to supplement movement of the cleaner body by the main wheels 111.

Figure 3:
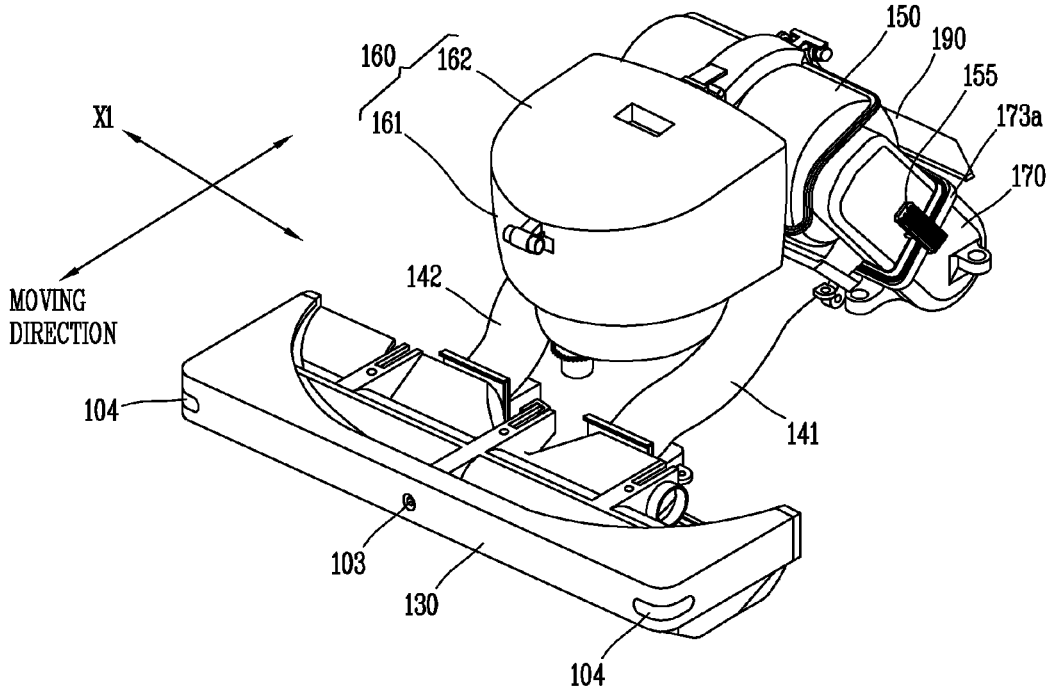
FIG. 3 is a conceptual view illustrating main components inside the robot cleaner of FIG. 1.
Figure 4:
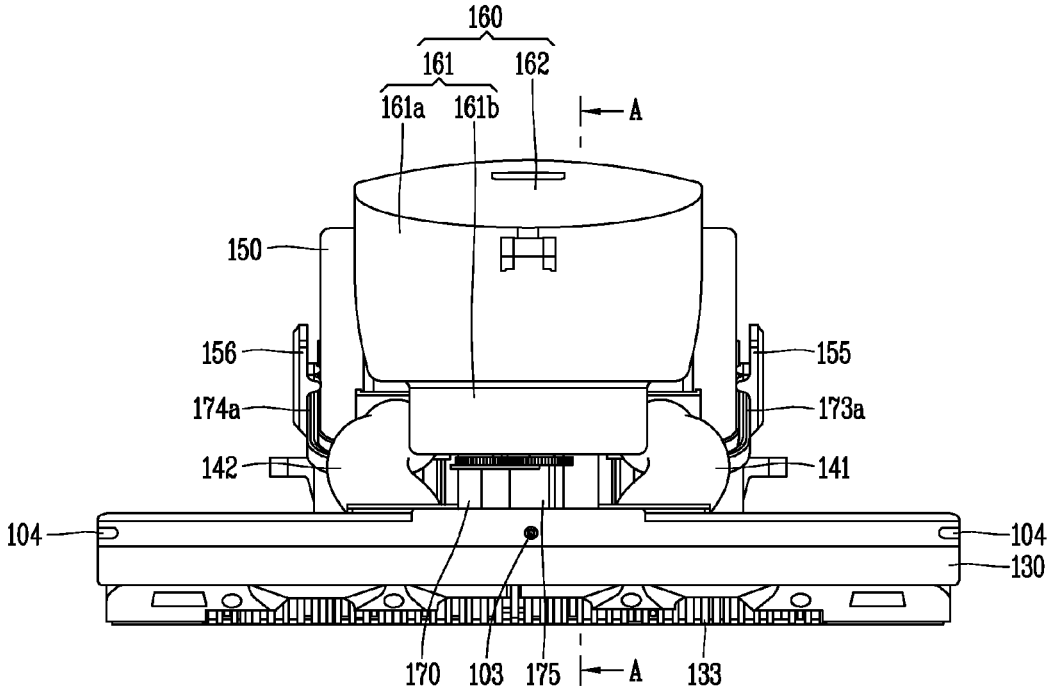
FIG. 4 is a front view of the robot cleaner of FIG. 3.
Figure 5:
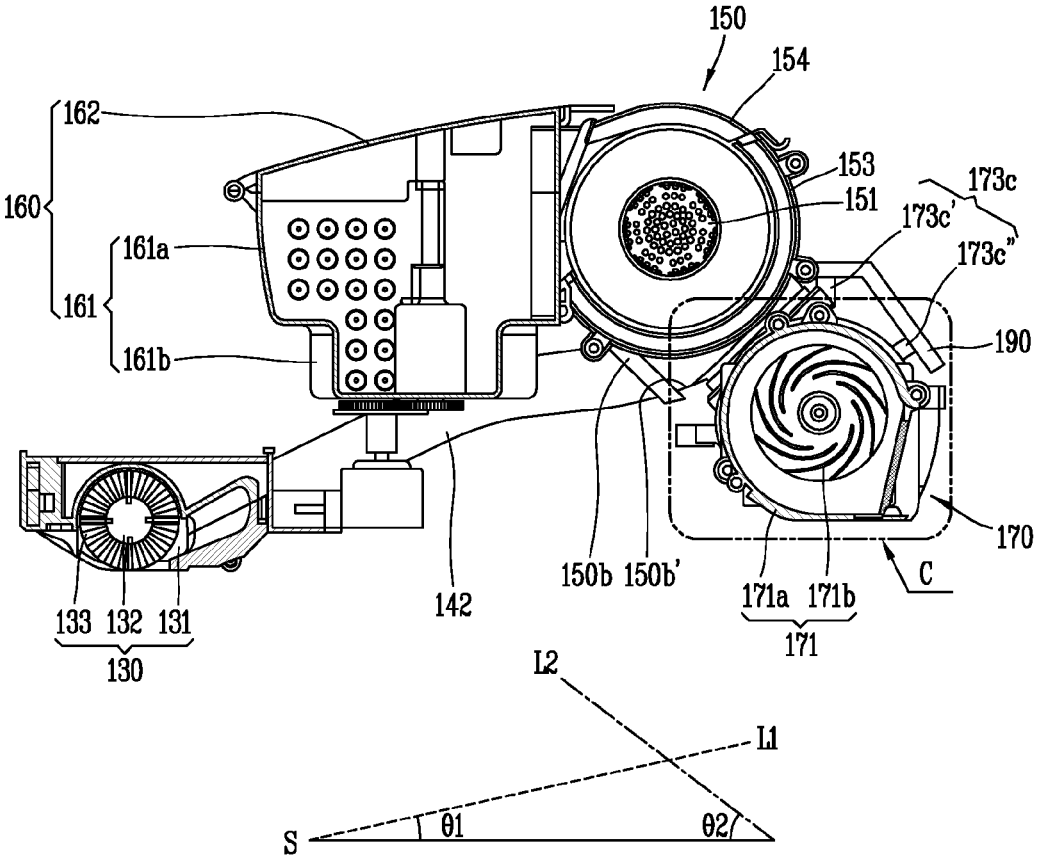
FIG. 5 is a sectional view taken along line 'A-A' in FIG. 4.

Referring to FIGS. 3 to 5, the robot cleaner 100 includes a suction unit or module 130, a first guiding member 141 (or first air flow guide), a second guiding member 142 (or second air flow guide), a cyclone unit or module 150 and a fan unit or module 170. The suction unit or module 130 is provided at a bottom portion of the cleaner body 101, and is configured to suck dust or dirt contained air (dirty air) on a floor by the fan unit 170. The suction unit 130 may be arranged at a front side of the cleaner body 101, and may be detachably mounted to the cleaner body 101. The position of the suction unit 130 is related to a moving direction of the robot cleaner 100 when the robot cleaner 100 is normally operated.

An obstacle sensor 103 electrically connected to the controller and configured to sense an obstacle while the robot cleaner 100 moves and a damper 104 formed of an elastic material and configured to absorb a shock when the robot cleaner 100 collides with an obstacle may be provided at the suction unit 130. The obstacle sensor 103 and the damper 104 may be provided at the cleaner body 101.

Referring to FIG. 5, the suction unit 130 includes a suction opening 131, a roller 132 and a brush 133. The suction opening 131 may be formed to extend in a lengthwise direction of the suction unit 130. The roller 132 is rotatably installed at the suction opening 131, and the brush 133 is mounted to an outer circumferential surface of the roller 132. The brush 133 is configured to sweep up dust on a floor to the suction opening 131. The brush 133 may be formed of various materials including a fibrous material, an elastic material, etc.

The first guiding member 141 and the second guiding member 142 may be provided between the suction unit 130 and the cyclone unit 150, thereby connecting the suction unit 130 and the cyclone unit 150 to each other. The first guiding member 141 and the second guiding member 142 are spaced from each other. One ends of the first and second guiding members 141 and 142 coupled to the suction unit 130 may be fixed to the cleaner body 101.

Air sucked through the suction unit 130 is introduced into the cyclone unit 150 in a diverged manner, through the first and second guiding members 141 and 142. Such a configuration is advantageous in that air sucking efficiency is enhanced or improved, than in a case where a single guiding member is provided.

Figure 7A:
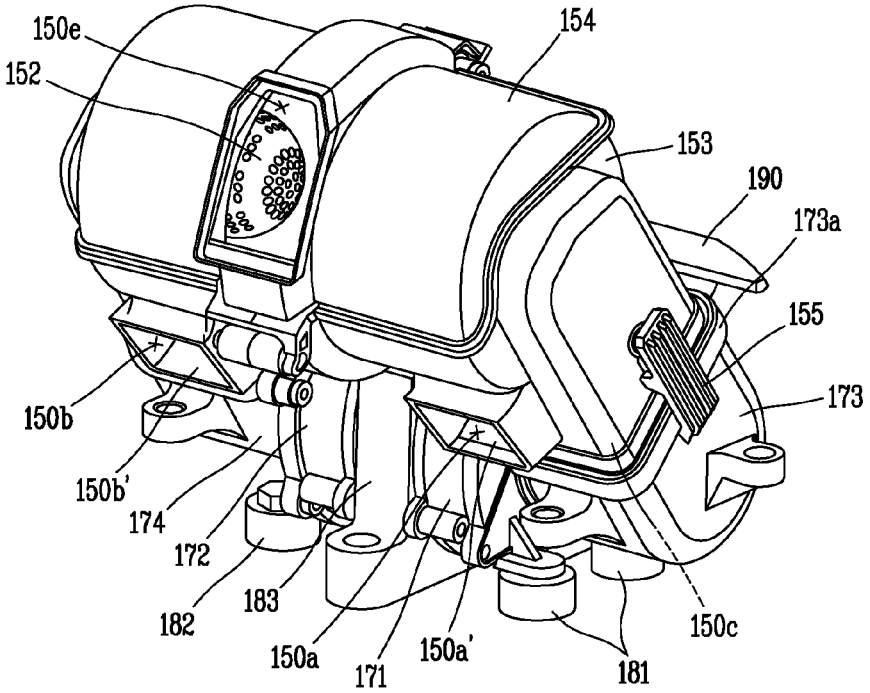
FIG. 7A is a perspective view of the cyclone unit and the fan unit of FIG. 6.

The first and second guiding members 141 and 142 may be disposed to be upward inclined toward the cyclone unit 150, so as to extend from the suction unit 130 toward the cyclone unit 150 (specifically, a first suction opening 150*a* and a second suction opening 150*b* shown in FIG. 7A), where the cyclone unit 150 is arranged at a rear upper side of the suction unit 130. The cyclone unit 150 may be provided with a cylindrical inner circumferential surface, and may be long-formed along a second direction (X1). The cyclone unit 150 may have an approximate cylindrical shape. The second direction (X1) may be a direction perpendicular to a moving (or first) direction of the robot cleaner 100.

The cyclone unit 150 is configured to filter at least one of dust or dirt (hereinafter, collectively referred to as "dust") from air sucked thereto through the suction unit 130. Air sucked into the cyclone unit 150 is rotated along an inner circumferential surface of the cyclone unit 150. During this process, dust is collected to a dust box or a storage chamber 160 communicated with a dust discharge opening 150*e* (FIG. 7A), and dirty air is introduced into a first cyclone 151 and a second cyclone 152.

The dust discharge opening 150*e* is formed at a front side of the cyclone unit 150. The dust discharge opening 150*e* may be formed between the first suction opening 150*a* and the second suction opening 150*b* (or between the first cyclone 151 and the second cyclone 152), i.e., at a central portion of the cyclone unit 150. Under such a structure, dust included in air introduced into two sides of the cyclone unit 150 through the first and second suction openings 150*a* and 150*b*, rotates along an inner circumferential surface of the cyclone unit 150, toward a central part from an end part of the cyclone unit 150. The dust is collected or blown to the dust box 160 through the dust discharge opening 150*e*.

The dust box 160 is connected to the cyclone unit 150, and is configured to collect dust filtered by the cyclone unit 150. In this embodiment, the dust box 160 is disposed between the suction unit 130 and the cyclone unit 150. The dust box 160 is detachably mounted to the cyclone unit 150 so as to be separable from the cleaner body 101. When a removable cover 102 coupled to the cleaner body 101 is opened, the dust box 160 may be in a separable state by being exposed to the outside. The dust box 160 may be configured to be exposed to the outside, thereby forming the appearance of the robot cleaner 100 together with the cleaner body 101. In such a case, a user can check the amount of dust accumulated in the dust box 160 without opening the cover 102.

The dust box 160 may include a dust box body or a dust storage chamber 161 and a dust box cover 162. The dust box body 161 forms a space for collecting dust filtered by the cyclone unit 150, and the dust box cover 162 is coupled to the dust box body 161 so as to open and close an opening of the dust box body 161. For instance, the dust box cover 162 may be configured to open and close the opening of the dust box body 161 by being hinge-coupled to the dust box body 161. The dust discharge opening 150*e* may be provided at the dust box body 161. However, the present disclosure is not limited to this. The dust discharge opening 150*e* may be also formed at the dust box cover 162 according to a modified design.

As aforementioned, the dust box 160 connected to the cyclone unit 150 may be formed to have a predetermined depth, since the cyclone unit 150 is arranged at an upper side of the suction unit 130. For efficient spatial arrangement, at least part of the dust box 160 may be accommodated in a space between the first guiding member 141 and the second guiding member 142.

In this embodiment, the dust box body 161 includes a first portion 161*a* and a second portion 161*b* having different sectional areas. The first portion 161*a* may communicate with the dust discharge opening 150*e*, and at least part of the first portion 161*a* may be disposed on the first and second guiding members 141 and 142. As shown in FIG. 4, in this embodiment, two sides of the first portion 161*a* are disposed on the first and second guiding members 141 and 142.

The second portion 161*b* is formed to extend to a lower side of the first portion 161*a*, and to have a smaller sectional area than the first portion 161*a*. At least part of the second portion 161*b* is accommodated in a space between the first and second guiding members 141 and 142. The first and second guiding members 141 and 142 may be formed such that at least part thereof is bent to enclose or support the second portion 161*b* at two sides.

Based on such a structure, dust collected into the dust box 160 is firstly accumulated in the second portion 161*b*. In a modified embodiment, an inclined portion or wall (not shown), inclined toward the second portion 161*b* so that dust can move to the second portion 161*b*, may be provided between the first portion 161*a* and the second portion 161*b*.

The dust box cover 162 may be arranged to be inclined so that at least part thereof can face the dust discharge opening 150*e*. Based on such a structure, dust introduced into the dust box 160 through the dust discharge opening 150*e* can the dust box cover 162 to be collected in the dust box body 161 (mainly, the second portion 161*b*).

The fan unit or module 170 is connected to the cyclone unit 150. The fan unit 170 includes a motor 175 configured to generate a driving or suction force, and a first fan part 171 and a second fan part 172 connected to two sides of the motor part 175 and configured to generate a suction force. A detailed structure of the fan unit 10 will be explained later (see, e.g., FIG. 9A).

The fan unit 170 may be fixed to the cleaner body 101, and may be provided at a rear lower side of the cyclone unit 150. For such an arrangement, the cyclone unit 150 is coupled onto the fan unit 170 (specifically, a first communication member 173 and a second communication member 174), thereby being spaced from an inner bottom surface of the cleaner body 101.

As shown in FIG. 5, an arbitrary line (L1), which connects two ends of the first guiding member 141 or the second guiding member 142 to each other, has an inclination angle (θ1), from an inner bottom surface (S) of the cleaner body 101. An arbitrary line (L2), which connects the cyclone unit 150 and the fan unit 170 to each other, has an inclination angle (θ2), from the inner bottom surface (S) of the cleaner body 101. As such inclination angles (θ1 and θ2) are controlled, a volume of the dust box 160 may be variously changed.

Figure 6:
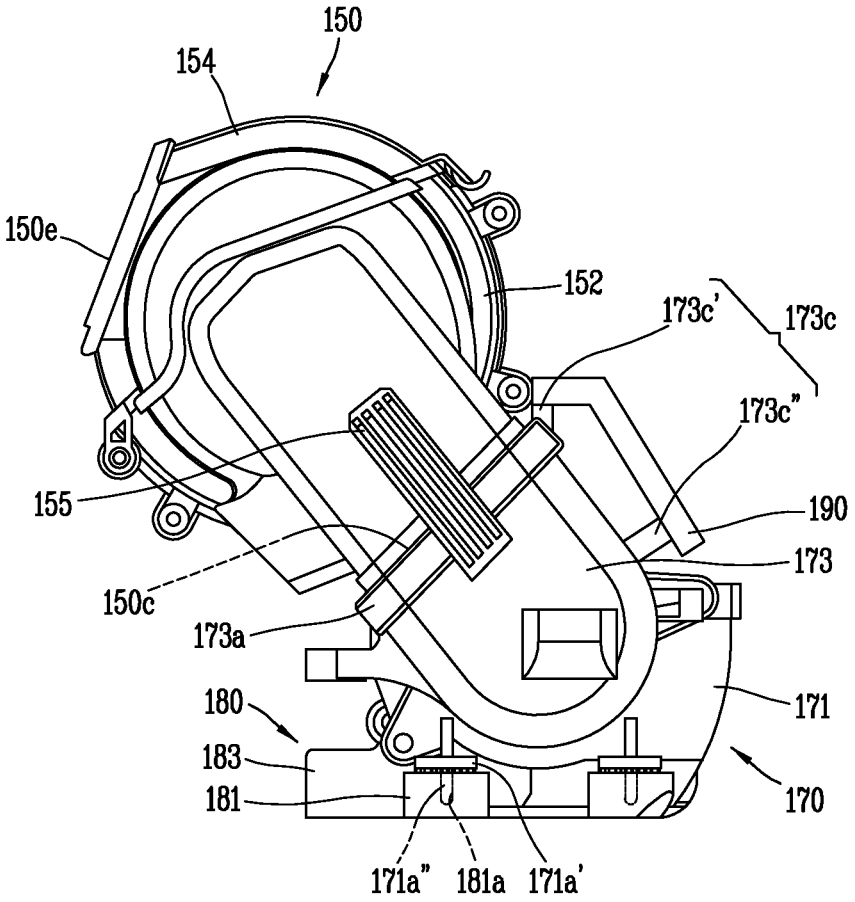
FIG. 6 is a side sectional view illustrating a cyclone unit and a fan unit separated from the robot cleaner of FIG. 3.

FIG. 6 is a side sectional view illustrating the cyclone unit 150 and the fan unit 170 separated from the robot cleaner 100 of FIG. 3. FIG. 7A is a perspective view of the cyclone unit 150 and the fan unit 170 of FIG. 6. The FIG. 7B illustrates a state where a second case 154 of the cyclone unit 150 of FIG. 7A has been removed.

Figure 7B:
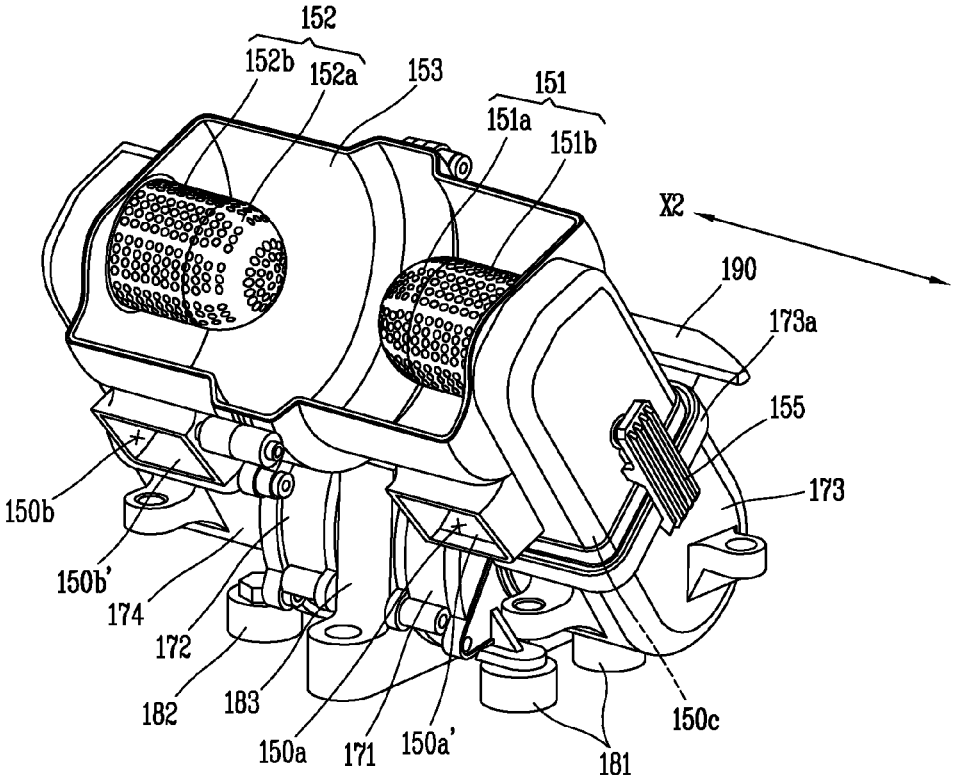
FIG. 7B illustrates a state where a second case of the cyclone unit of FIG. 7A has been removed.

Referring to FIGS. 6 to 7B together with the aforementioned figures, the cyclone unit 150 is provided with the first suction opening 150*a* communicated with the first guiding member 141, and the second suction opening 150*b* communicated with the second guiding member 142. The first suction opening 150*a* and the second suction opening 150*b* may be formed at two sides of the cyclone unit 150 such that air introduced into the cyclone unit 150 through the first suction opening 150*a* and the second suction opening 150*b* rotates along an inner circumferential surface of the cyclone unit 150, toward a central part from an end part of the cyclone unit 150.

The cyclone unit 150 may further include a first suction guide 150*a*' and a second suction guide 150*b*' configured to guide air sucked to the cyclone unit 150 through the first suction opening 150*a* and the second suction opening 150*b* to an inner circumferential surface of the cyclone unit 150, respectively. The first suction guide 150*a*' is formed at the first suction opening 150*a* toward an inner circumferential surface of the cyclone unit 150, and the second suction guide 150*b*' is formed at the second suction opening 150*b* toward an inner circumferential surface of the cyclone unit 150.

The cyclone unit 150 is provided therein with the first cyclone 151 and the second cyclone 152 such that air and dust are introduced into the first cyclone 151 and the second cyclone 152. The first cyclone 151 has a structure that an air passing hole 151*b* is formed at a protruding member 151*a* having a hollow inner space, and the second cyclone 152 has a structure that an air passing hole 152*b* is formed at a protruding member 152*a* having a hollow inner space. Dust of prescribed size cannot pass through the air passing holes 151*b* and 152*b*, whereas air (with fine dust smaller than the prescribed size) can pass through the air passing holes 151*b* and 152*b* to flow into the hollow inner spaces of the protruding members 151*a* and 152*a*.

As shown, the first cyclone 151 may be arranged close to the first suction opening 150*a*, and the second cyclone 152 may be arranged close to the second suction opening 150*b*. Under such a structure, air and dust sucked into the cyclone unit 150 through the first suction opening 150*a* is mainly introduced into the first cyclone 151, and air and dust sucked into the cyclone unit 150 through the second suction opening 150*b* is mainly introduced into the second cyclone 152. Dust may be efficiently filtered from the sucked air, and the dust-filtered air can be more efficiently discharged from the cyclone unit 150.

The first and second cyclones 151 and 152 may be provided at two ends of the cyclone unit 150 in a facing manner. In this case, the first and second cyclones 151 and 152 may be formed to protrude from the same axis (X2). The axis (X2) may be perpendicular to a moving direction (forward or backward direction) of the robot cleaner 100. The axis (X2) may be identical to the aforementioned a second direction (X1).

The first and second cyclones 151 and 152 may be arranged at central regions of two end portions of the cyclone unit 150 so as to have a preset separating distance from an inner circumferential surface of the cyclone unit 150. Under such a structure, dust can rotate along an inner circumferential surface of the cyclone unit 150, and dust-filtered air can be mainly introduced into the first and second cyclones 151 and 152.

Figure 8:
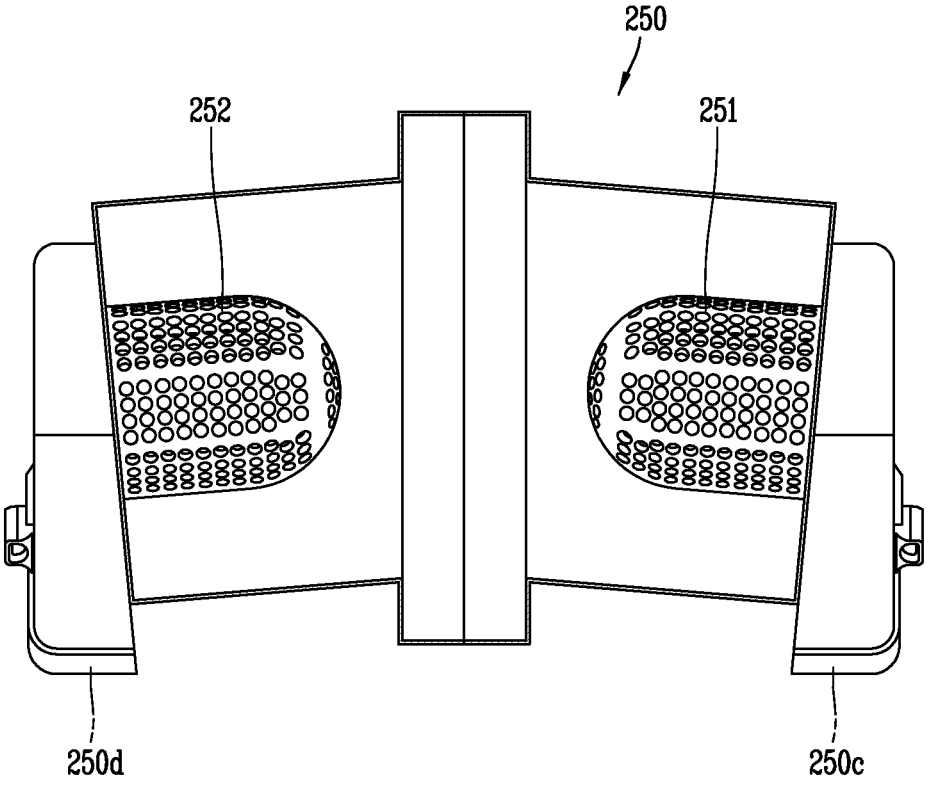
FIG. 8 illustrates a modification example of the cyclone unit of FIG. 7A.

Referring to FIG. 8 illustrating a modification example of the cyclone unit 150 of FIG. 7A, a cyclone unit 250 may be configured so that air which has passed through first and second suction openings (not shown) can be introduced toward a central part of the cyclone unit 250. Under such a structure, air introduced into the cyclone unit 250 can easily rotate toward a central part of the cyclone unit 250 from an end part of the cyclone unit 250.

In the drawings, the cyclone unit 250 is arranged so that a region for accommodating a first cyclone 251 and a region for accommodating a second cyclone 252 have a preset angle therebetween. The preset angle viewed from a front side may be 180° or less.

The first and second suction openings may be formed toward a central part of the cyclone unit 250 such that air is introduced into the central part of the cyclone unit 250. The first and second suction guides (not shown) aforementioned with reference to the aforementioned embodiment may be formed to extend toward the central part of the cyclone unit 250.

Referring back to FIGS. 6 and 7B, the cyclone unit 150 may include a first case 153 and a second case 154. The first case 153 is provided with the first and second suction openings 150*a* and 150*b* and the first and second cyclones 151 and 152, and is configured to be coupled to the first and second guiding members 141 and 142. The second case 154 is provided with a dust discharge opening 150, and is removably coupled to the first case 153. For example, the second case 154 may be hinge-coupled to the first case 153, and may be configured to open and close the first case 153 by being rotated.

Under such a configuration, as the second case 154 is separated from the first case 153 or rotated, and inside of the cyclone unit 150 may be exposed. This is advantageous in that dust or dirt, collected in the air passing holes 151*b* and 152*b* of the first and second cyclones 151 and 152 without having passed therethrough, can be easily removed.

As shown in FIGS. 7B and 8, the cyclone unit 150 may further include a first discharge opening 150*c* and a second discharge opening (opposite side of cyclone unit 250C) communicated with inner spaces of the first and second cyclones 151 and 152 so that dust/dirt filtered air can be discharged. As shown, the first discharge opening 150*c* and the second discharge opening (not shown) may be provided at two sides of the cyclone unit 150. Although the second discharge opening is not visible in the drawings, the second discharge opening may be understood as a mirror image of the first discharge opening 150*c* shown in FIG. 7A. The fan unit 170 may be connected to each of the first discharge opening 150*c* and the second discharge opening, such that filtered air is discharged to the outside. As shown in FIG. 7B, the second discharge opening (similar to the first discharge opening) has a hollow interior in communication with the hollow interior of the second cyclone 152.

Figure 9A:
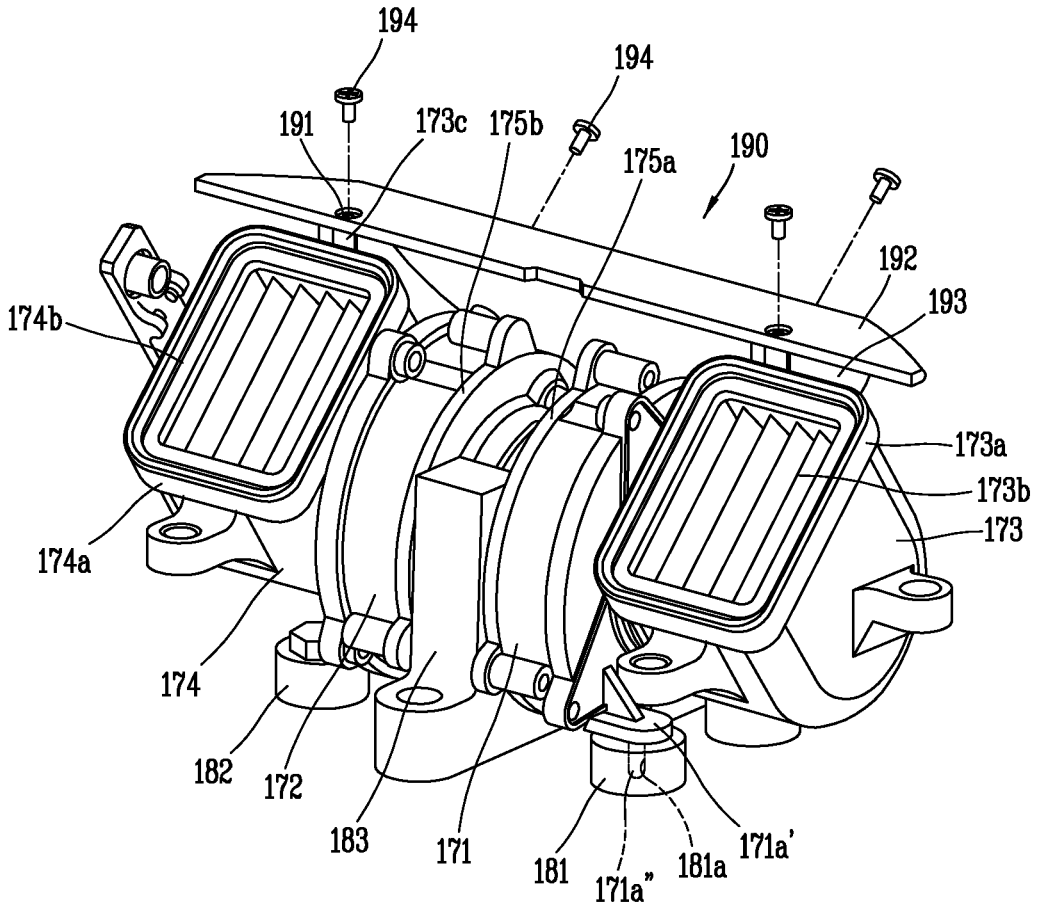
FIG. 9A is a perspective view of the fan unit shown in FIG. 6.
Figure 9B:
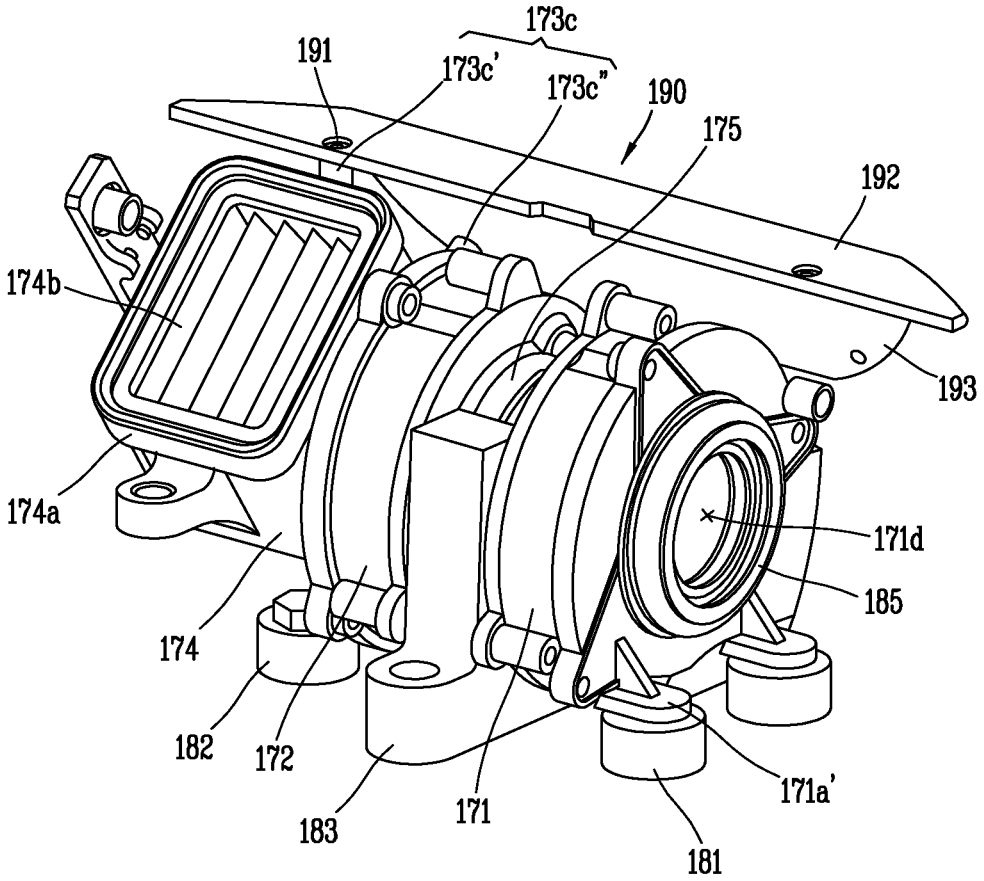
FIG. 9B illustrates a state where a first communication member has been removed from the fan unit of FIG. 9A.
Figure 9C:
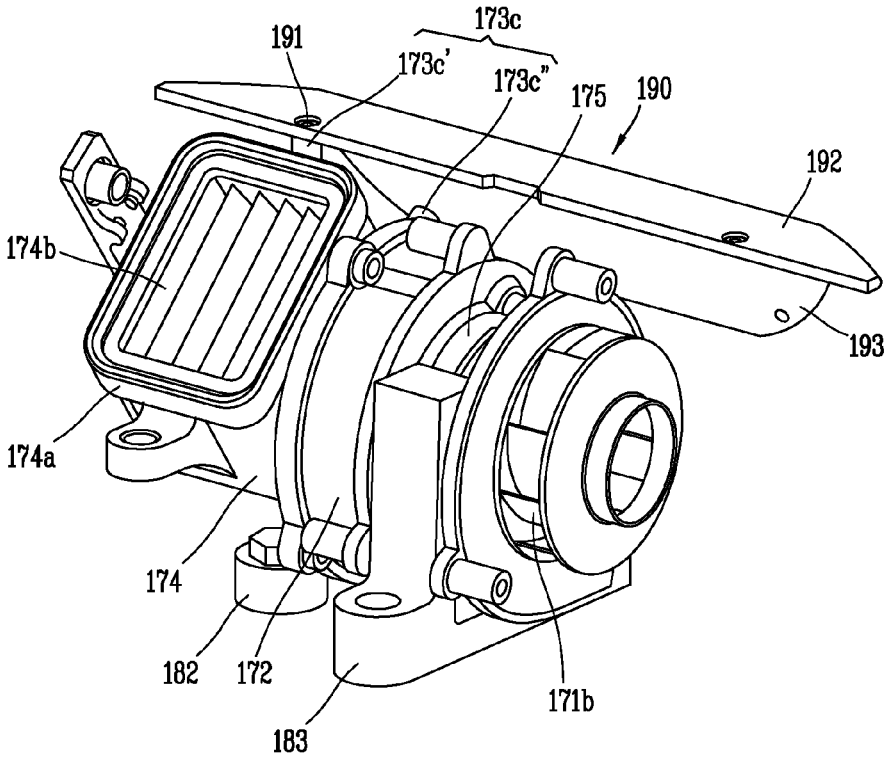
FIG. 9C illustrates a state where a first fan cover has been removed from the fan unit of FIG. 9B.
Figure 9D:
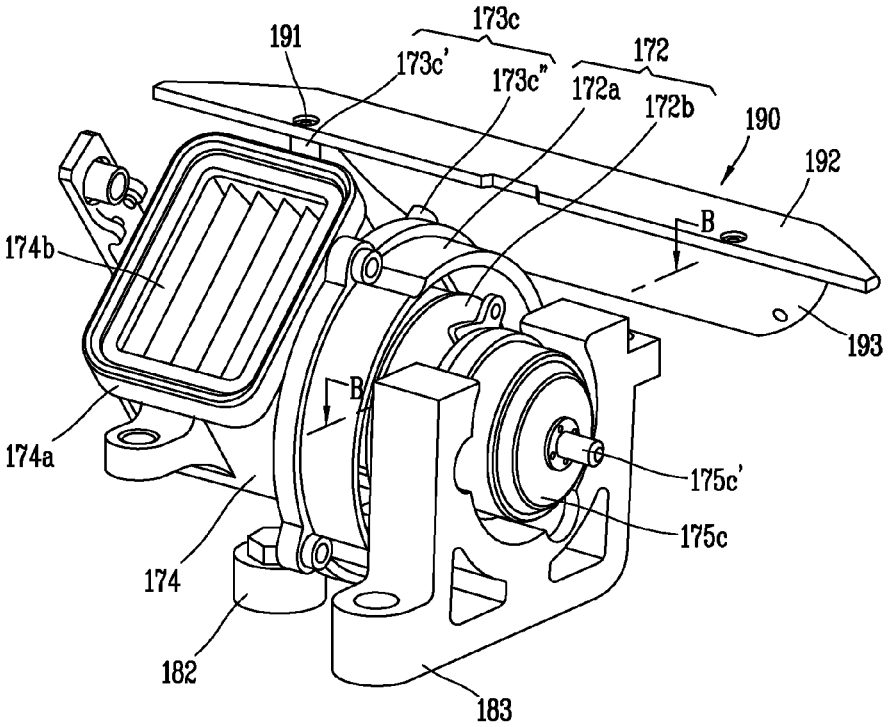
FIG. 9D illustrates a state where a first fan, a first motor housing and a second motor housing have been removed from the fan unit of FIG. 9C.
Figure 9E:
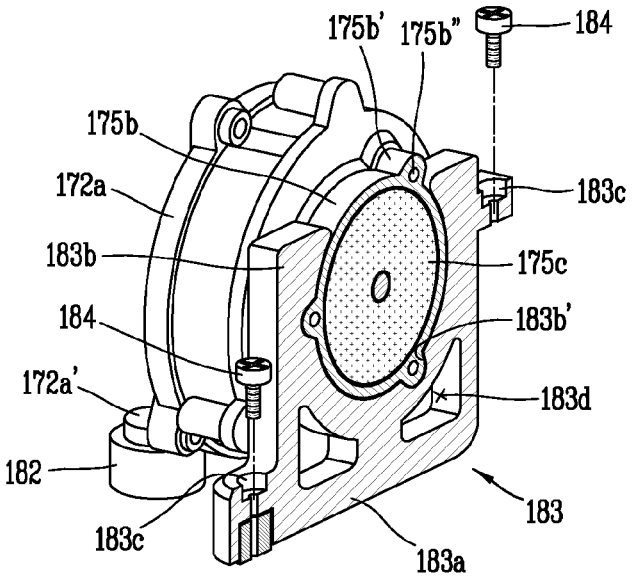
FIG. 9E is taken along line 'B-B' in the fan unit shown in FIG. 9D.

FIG. 9A is a perspective view of the fan unit 170 shown in FIG. 6, FIG. 9B illustrates a state where a first communication member 173 has been removed from the fan unit 170 of FIG. 9A, and FIG. 9C illustrates a state where a first fan cover 175 has been removed from the fan unit 170 of FIG. 9B. FIG. 9D illustrates a state where a first fan 171*b*, a first motor housing 175*a* and a second motor housing 175*b* have been removed from the fan unit 170 of FIG. 9C. FIG. 9E is a view taken along line 'B-B' in the fan unit 170 shown in FIG. 9D.

The fan unit 170 includes a motor part 175, a first fan part 171, a second fan part 172, a first communication member 173 and a second communication member 174. Although the second fan part 172 is not visible in the drawings, the second fan part 172 may be understood as a mirror image of the first fan part 171 shown in FIG. 9C.

The motor part or module 175 may be configured to generate a driving or a suction force, and may be provided at a central part of the fan unit 170. The motor part 175 includes a motor 175*c*, and a motor housing for accommodating the motor 175*c* therein. The motor 175*c* may be provided with rotation shafts at two sides thereof. The motor housing may be composed of a first motor housing 175*a* and a second motor housing 175*b* coupled to each other to accommodate the motor 175*c* therein.

The first fan part or module 171 and the second fan part or module 172 are connected to two sides of the motor part 175. The first fan part 171 includes a first fan 171*b* connected to a rotation shaft 175*c*' provided at one side of the motor 175*c*, and a first fan cover 171*a* configured to accommodate the first fan 171*b* therein. And the second fan part 172 includes a second fan 172*b* connected to a rotation shaft provided at another side of the motor 175*c*, and a second fan cover 172*a* configured to accommodate the second fan 172*b* therein.

The first and second fans 171*b* and 172*b* are configured to generate a suction force by being rotated when the motor 175*c* is driven, and to discharge filtered air to the outside. Each of the first and second fans 171*b* and 172*b* may be a volute fan.

The first fan cover 171*a* is provided with a first air inlet 171*d* (FIG. 9B) in a direction of a rotation shaft of the first fan part 171, and is provided with a first air outlet 171*e* (FIG. 10) in a radius direction of the first fan part 171. Likewise, the second fan cover 172*a* is provided with a second air inlet in a direction of a rotation shaft of the second fan part 172, and is provided with a second air outlet in a radius direction of the second fan part 172. Although the second air inlet and the second air outlet are not visible in the drawings, the second air inlet may be understood as a mirror image of the first air inlet 171*d* shown in FIG. 9B, and the second air outlet may be understood as a mirror image of the first air outlet 171*e* shown in FIG. 10.

A mechanism to suck and discharge air according to such a structure will be explained in more detail. Dust-filtered air is introduced into the first fan cover 171*a* through the first air inlet 171*d* by a suction force due to rotation of the first fan part 171. The air is moved to a side direction by rotation of the first fan part 171 implemented as a volute fan, and is discharged out through the first air outlet 171*e*. Such a mechanism may be equally applied to processes to suck and discharge air by rotation of the second fan part 172.

The first communication member 173 is configured to connect the first discharge opening 150*c* of the cyclone unit 150 with the first fan part 171, and thus to guide air introduced into the inner space of the first cyclone 151 into the first fan part 171. Likewise, the second communication member 174 is configured to connect the second discharge opening of the cyclone unit 150 with the second fan part 172, and thus to guide air introduced into the inner space of the second cyclone 152 into the second fan part 172.

As aforementioned (refer to FIGS. 6 to 7B), in a case where the cyclone unit 150 includes the first case 153 and the second case 154, the first case 153 may be provided with the first discharge opening 150*c* and the second discharge opening, and may be coupled to each of the first and second communication members 173 and 174.

A first coupling member 155 for coupling with the first communication member 173, and a second coupling member 156 for coupling with the second communication member 174 may be provided at two sides of the first case 153.

For instance, each of the first and second coupling members 155 and 156 may include a hook and an elastic member. More specifically, the hooks are rotatably coupled to two sides of the first case 153, and are locked by the first and second communication members 173 and 174. The elastic members are configured to elastically press the hooks so that a locked state of the hooks to the first and second communication members 173 and 174 can be maintained. The first and second communication members 173 and 174 may be provided with locking protrusions 173*a* and 174*a* configured to lock the hooks so that the first case 153 can be prevented from being separated from the first and second communication members 173 and 174.

Coupling of the first case 153 with the first and second communication members 173 and 174 is not limited to the above coupling. That is, the first case 153 may be coupled with the first and second communication members 173 and 174 in various manners without an additional coupling member, e.g., by using a locking structure or by bonding.

Fine dust filters 173*b* and 174*b*, configured to filter fine dust from dust-filtered air, may be mounted to the first and second communication members 173 and 174. As the fine dust filters 173*b* and 174*b*, HEPA filters may be used. For replacement, the fine dust filters 173*b* and 174*b* may be configured to be exposed to the outside when the cyclone unit 150 is separated from the first and second communication members 173 and 174.

When the motor 175*c* of the fan unit 170 and the first and second fans 171*b*, 172*b* are driven, vibrations occur from the robot cleaner. If a suction force is increased for enhancement of a cleaning function, the motor 175*c* and the first and second fans 171*b*, 172*b* are rotated more rapidly. This may cause severe vibrations.

To solve such problems, a supporting unit 180 configured to support the fan unit 170 may be disposed between an inner bottom surface of the cleaner body 101 and the fan unit 170. The supporting unit 180 is formed of an elastic material (e.g., rubber, urethane, silicone, etc.) so as to absorb vibrations generated from the fan unit 170. The supporting unit 180 is configured to elastically support the motor part 175, the first fan part 171 and the second fan part 172 which are the main components where vibrations occur. The supporting unit 180 includes a motor supporting member 183 configured to elastically support the motor part 175, and first and second fan supporting members 181, 182 configured to elastically support the first and second fan parts 171, 172.

The motor supporting member 183 is installed on an inner bottom surface of the cleaner body 101, and is formed to enclose or surround at least part of the motor part 175. Referring to FIGS. 9D and 9E, the motor supporting member 183 is formed to enclose an outer circumference of the motor housings 175*a*, 175*b*.

Referring to FIG. 9E, the motor supporting member 183 may include a base part 183*a* installed on the inner bottom surface of the cleaner body 101, and an extending part 183*b* upward extending from the base part 183*a* so as to enclose at least part of the motor part 175. The base part 183*a* and the extending part 183*b* may be integrally formed with each other by injection molding.

Coupling holes 183*c* are formed at the motor supporting member 183, and coupling members 184 (e.g., fasteners) to the inner bottom surface of the cleaner body 101 through the coupling holes 183*c*, thereby fixing the motor supporting member 183 to the cleaner body 101. In the drawings, the coupling holes 183*c* are formed at two sides of the motor supporting member 183.

A plurality of ribs protrude from an outer circumference of the first motor housing 175*a*, and a plurality of ribs 175*b*' (FIG. 9E) protrude from an outer circumference of the second motor housing 175*b*. The ribs 175*b*' are provided therein a coupling structure. For instance, the ribs of the first motor housing 175*a* are provided with protrusions, and the ribs 175*b*' of the second motor housing 175*b* are provided with accommodation grooves 175*b*" for accommodating the protrusions therein. As the protrusions are fitted into the accommodation grooves 175*b*", the first motor housing 175*a* and the second motor housing 175*b* may be coupled to each other.

An inner side of the extending part 183*b* may be formed to correspond to an outer circumference of the motor part 175, so as to enclose at least part of the motor part 175. The extending part 183*b* may be formed to cover at least one of the aforementioned plurality of ribs 175*b*'. In this case, an accommodation groove 183*b*' is formed in the extending part 183*b*, in correspondence to the at least one rib. With such a configuration, as the rib 175*b*' is accommodated in the accommodation groove 183*b*', the motor part 175 may be fixed to the motor supporting member 183 more stably.

A hollow part 183*d* may be formed between the base part 183*a* and the extending part 183*b*, thereby reducing vibrations from being transmitted to the base part 183*a* from the extending part 183*b*. In the drawings, the hollow part 183*d* is formed at the motor supporting member 183 in plurality.

The first and second fan supporting members 181, 182 are configured to elastically support the first and second fan covers 171*a*, 172*a*, respectively. In the drawings, protruding parts 171*a*', 172*a*' protrude from the first and second fan covers 171*a*, 172*a*, so as to face the inner bottom surface of the cleaner body 101. The first and second fan supporting members 181, 182 are disposed between the inner bottom surface of the cleaner body 101 and the protruding parts 171*a*', 172*a*'.

The first and second fan supporting members 181, 182 may be fixed to the protruding parts 171*a*', 172*a*'. For instance, referring to FIGS. 6 and 9A, a protrusion 171*a*" may be formed to protrude from the protruding part 171*a*', toward the inner bottom surface of the cleaner body 101. An insertion groove 181*a* configured to insert the protrusion 171*a*" may be formed at the first fan supporting member 181. The first and second fan supporting members 181, 182 may be coupled to the protruding parts 171*a*', 172*a*', respectively, by another coupling structure, e.g., a coupling structure using screws, a bonding coupling structure, etc.

The first and second fan supporting members 181, 182 may be fixed to the inner bottom surface of the cleaner body 101, or may be supported on the inner bottom surface of the cleaner body 101 in a non-fixed state. In the case where the first and second fan supporting members 181, 182 are fixed to the inner bottom surface of the cleaner body 101, a coupling structure using screws may be used.

As aforementioned, the first fan part 171 is connected to the first communication member 173, and the second fan part 172 is connected to the second communication member 174. Accordingly, vibrations generated from the first and second fan parts 171, 172 may be transmitted to the first and second communication members 173, 174 and noise may occur as the components come in contact with each other.

For reduction of such noise, a first connection member 185, formed of an elastic material so as to absorb vibrations generated from the first fan part 171, may be disposed between the first fan part 171 and the first communication member 173. Likewise, a second connection member (not shown), formed of an elastic material so as to absorb vibrations generated from the second fan part 172, may be disposed between the second fan part 172 and the second communication member 174.

Referring to FIG. 9B, the first connection member 185 may be formed to have a ring shape so as to enclose the first air inlet 171*d* of the first fan cover 171*a*. The first connection member 185 is pressurized when the first fan part 171 and the first communication member 173 are coupled to each other, thereby being fitted to the first fan part 171 and the first communication member 173. The second connection member may be also formed to have a ring shape so as to enclose the second air inlet, in correspondence to the first connection member 185. The second connection member is formed to seal a gap occurring when the second communication member 174 and the second fan part 172 are coupled to each other.

The fan unit 170 may be a main component of the robot cleaner 100 where noise occurs. Moreover, since the robot cleaner 100 of the present disclosure is provided with the plurality of fan parts 171, 172 corresponding to the plurality of cyclones 151, 152, noise occurs. Hereinafter, a structure for reducing noise generated from the fan unit 170 will be explained.

Referring to FIGS. 9A to 9E with FIG. 6, a noise reducing member 190 is disposed above the fan unit 170 so as to reduce noise. As shown, the noise reducing member 190 extends toward two sides of the motor part 175, thereby covering the first and second fan parts 171, 172. If necessary, the noise reducing member 190 may more extend to cover the first and second communication members 173, 174.

For smooth exhaustion, the noise reducing member 190 is formed not to cover the first air outlet 171*e* of the first fan cover 171*a* and the second air outlet of the second fan cover 172*a*. The noise reducing member 190 extends to a lower side of the fan unit 170 from an upper side of the fan unit 170. In this case, the noise reducing member 190 may extend up to an upper side of the first and second air outlets, or may be provided with exhaustion holes at parts corresponding to the first and second air outlets.

As the noise reducing member 190 is disposed to cover an upper side of the fan unit 170, noise generated from the motor 175*c* and the first and second fans 171*b*, 172*b* may be prevented from being transmitted to the upper side of the fan unit 170. As noise is concentrated or directed into the inner bottom surface by the noise reducing member 190, a user may receive noise of a low level.

The noise reducing member 190 may reduce noise by irregularly reflecting or absorbing noise generated from the fan unit 170. For diffused reflection of noise, an inner side surface of the noise reducing member 190, which faces the fan unit 170, may have a concavo-convex structure. For absorption of noise, a noise absorbent configured to absorb at least part of noise may be attached to the inner side surface of the noise reducing member 190, which faces the fan unit 170. The noise absorbent may be formed of a porous material such as a sponge.

The noise reducing member 190 is disposed to cover most regions of the upper side of the fan unit 170. However, in some cases, the noise reducing member 190 may be disposed to cover a partial region of the upper side of the fan unit 170. Referring to FIG. 5, the cyclone unit 150 is connected to a front upper side of the fan unit 170. In this case, the noise reducing member 190 may be installed at the fan unit 170 so as to cover a rear upper side of the fan unit 170.

Since the noise reducing member 190 is configured to reduce noise generated from the motor 175*c* and the first and second fans 171*b*, 172*b*, the noise reducing member 190 may be installed at the fan unit 170. In the drawings, the noise reducing member 190 is mounted to the first and second communication members 173, 174. However, the installation position of the noise reducing member 190 is not limited to the fan unit 170. That is, the noise reducing member 190 may be mounted to any region adjacent to the fan unit 170, e.g., the cyclone unit 150, the inside of the cleaner body 101, etc. For instance, the noise reducing member 190 may be installed at the first case 153 of the cyclone unit 150, and may extend from the first case 153 toward the fan unit 170 so as to cover an upper side of the fan unit 170.

An installation structure of the noise reducing member 190 will be explained in more detail. A coupling boss 173*c* for coupling with the noise reducing member 190 protrudes from each of the first and second communication members 173, 174. Referring to FIGS. 5 and 9A, a first coupling boss 173*c*' and a second coupling boss 173*c*", which protrude toward the noise reducing member 190, are provided at the first communication member 173. The noise reducing member 190 is spaced apart from the fan unit 170, in a supported state by the first and second coupling bosses 173*c*', 173*c*". Coupling members 194 are coupled to the first and second coupling bosses 173*c*', 173*c*" via coupling holes of the noise reducing member 190, thereby fixing the noise reducing member 190 to the first communication member 173.

The noise reducing member 190 extends along a direction, so as to cover the motor part 175 and the first and second fan parts 171, 172 disposed at two sides of the motor part 175. The noise reducing member 190 may extend toward a lower side of the fan unit 170, from an upper side of the fan unit 170.

For instance, as shown, the noise reducing member 190 includes a base part or plate 192 and an extending or plate part 193. The base part 192 and the extending part 193 may have a flat shape, and may be connected to each other in a bent manner. The base part 192 is disposed to cover an upper side of the fan unit 170, and is mounted to the first coupling bosses 173*c*' of the first and second communication members 173, 174 by the coupling members 194. The extending part 193 downward extends from the base part 192 in a bent manner, thereby covering a rear upper side of the fan unit 170. The extending part 193 is mounted to the second coupling bosses 173*c*" of the first and second communication members 173, 174 by the coupling members 194. For smooth exhaustion, the extending part 193 is disposed not to cover the first air outlet 171*e* of the first fan cover 171*a*, and the second air outlet of the second fan cover 172*a*.

A noise absorbent, configured to absorb at least part of noise generated from the fan unit 170, may be attached to the inside of at least one of the base part 192 and the extending part 193. The noise reducing member 190 may be formed to have a rounded shape corresponding to the appearance of the fan unit 170, so as to enclose at least part of the fan unit 170. For instance, the noise reducing member 190 may be formed in a semi-circular shape, and may be disposed to cover a rear upper side of the fan unit 170.

Figure 10:
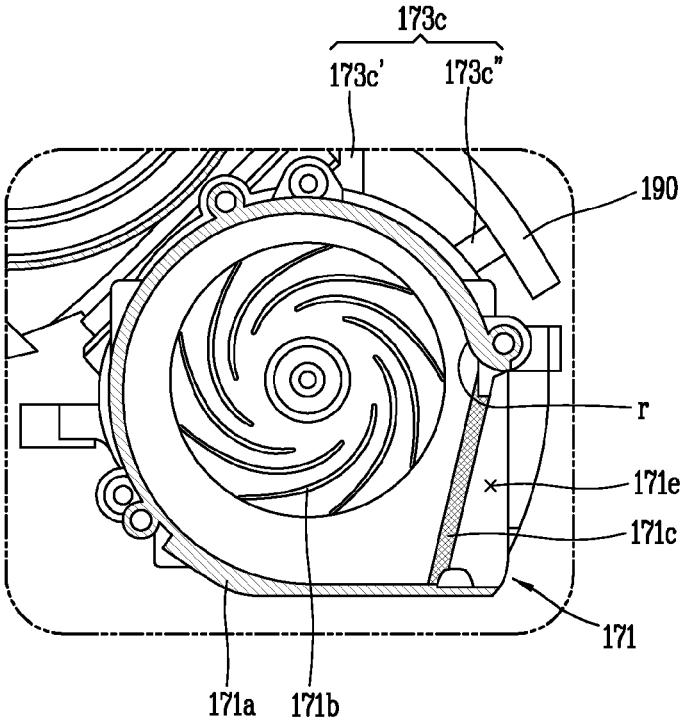
FIG. 10 is an enlarged view of part 'C' shown in FIG. 5.

For noise reduction and air volume increase when the first and second fan parts 171, 172 are driven, the following structure may be applied. This will be explained in more detail with reference to FIG. 10. FIG. 10 is an enlarged view of part 'C' shown in FIG. 5.

Referring to FIG. 10, a gap may be maintained between an inner circumferential surface of the first fan cover 171*a*, and an inner portion of the first fan 171*b* disposed close to the inner circumferential surface of the first fan cover 171*a*. Likewise, a gap may be maintained between an inner circumferential surface of the second fan cover 172*a*, and an inner portion of the second fan 172*b* disposed close to the inner circumferential surface of the second fan cover 172*a*.

The first fan cover 171*a* may be provided with a first exhaustion guide (r) and the second fan cover 172*a* may be provided with a second exhaustion guide, each exhaustion guide for guiding smooth exhaustion of dust-separated air. This will be explained in more detail with reference to the first exhaustion guide (r). The first exhaustion guide (r) may extend from an inner circumferential surface of the first fan cover 171*a* toward the first air outlet 171*e*, in a rounded manner. Although the second exhaustion guide is not visible, the second exhaustion guide may be understood as a mirror image of the first exhaustion guide (r) shown in FIG. 10.

A first exhaustion hole (not shown) corresponding to the first air outlet 171*e*, and a second exhaustion hole (not shown) corresponding to the second air outlet may be formed at the cleaner body 101.

For exhaustion of cleaner air, a fine dust filter 171*c* may be mounted to at least one of the first fan cover 171*a* and the cleaner body 101. As the fine dust filter 171*c*, a HEPA filter may be used to filter fine dust smaller than the prescribed size. The fine dust filter 171*c* is mounted to cover at least one of the first air outlet 171*e* and the first exhaustion hole, and is configured to filter fine dust from dust-separated air. Likewise, the fine dust filter 171*c* may be mounted to at least one of the second fan cover 172*a* and the cleaner body 101.

As aforementioned, in the present disclosure, since the dust box is disposed between the suction unit and the cyclone unit, a compact design may be implemented. Further, effective air flow (having a flow change more than 90°) may be generated for separation of dust.

The robot cleaner according to the present disclosure can have the various advantages.

Since a plurality of cyclones are provided in a single cyclone unit, dust can be efficiently separated from sucked air. For enhanced separation of dust, a plurality of guiding members are provided in correspondence to the plurality of cyclones, such that air sucked through the suction unit is introduced into the cyclone unit in a separated manner. The fan unit is configured such that air having passed through the plurality of cyclones is discharged to the outside. With such a structure, dust is separated from sucked air in a more efficient manner, and the dust-separated air is exhausted to the outside. This can enhance performance of the robot cleaner.

Further, the robot cleaner of the present disclosure is provided with the suction guide for guiding sucked air to the inner circumferential surface of the cyclone unit, and the exhaustion guide extending from the inner circumferential surface of the fan cover toward the air outlet in a rounded manner. With such a structure, the robot cleaner can reduce noise occurring when air is sucked and discharged to the outside.

Further, since dust having a large particle size is firstly filtered by the cyclone unit, and then fine dust is filtered by the fine dust filter provided on at least one of the suction side and the exhaustion side of the fan unit. This can allow cleaner air to be discharged to the outside of the robot cleaner.

In the present disclosure, the cyclone unit having the plurality of cyclones is disposed on the rear upper side of the suction unit, and the plurality of connection members are formed with an inclination angle so as to connect the suction unit and the cyclone unit to each other. And the fan unit is disposed on the rear lower side of the cyclone unit. With such a new structure and arrangement, the robot cleaner can have efficient spatial arrangement and enhanced cleaning performance.

Further, in a case where at least part of the dust box is accommodated in a space between the plurality of connection members, the dust box can have a larger capacity within the restricted space.

Noise of the robot cleaner is mainly generated from driving of the motor and the fan. Considering this, the noise reducing member is disposed above the fan unit to prevent noise generated from the fan unit from being transmitted to the upper side. This can allow the robot cleaner to have low noise.

Further, in the present disclosure, the motor supporting member configured to elastically support the motor part, and the first and second fan supporting members configured to elastically support the first and second fan parts are provided. This can reduce vibrations and noise generated from the fans.

In accordance with the present disclosure a robot cleaner may include a cleaner body forming appearance; a suction unit provided at the cleaner body, and configured to suck dust-included air; a first guiding member and a second guiding member communicated with the suction unit, and spaced apart from each other; a cyclone unit configured to separate dust from air sucked through the first and second guiding members, using a centrifugal force; a fan unit connected to the cyclone unit, and including a motor part, and a first fan part and a second fan part connected to two sides of the motor part and configured to generate a suction force; and a noise reducing member disposed to cover an upper side of the fan unit so as to reduce noise, and extending toward two sides of the motor part to cover the first and second fan parts.

In an embodiment of the present disclosure, a noise absorbent configured to absorb at least part of noise may be attached to an inner side of the noise reducing member, the inner side facing the fan unit.

In an embodiment of the present disclosure, the noise absorbent may be formed as a sponge.

In an embodiment of the present disclosure, the cyclone unit may be connected to a front upper side of the fan unit, and the noise reducing member may be installed at the fan unit so as to cover a rear upper side of the fan unit.

In another embodiment of the present disclosure, the fan unit may further include: a first communication member configured to communicate the first fan part with a first cyclone provided at the cyclone unit; and a second communication member configured to communicate the second fan part with a second cyclone provided at the cyclone unit. And the noise reducing member may be mounted to the first and second communication members.

In an embodiment of the present disclosure, a coupling boss, configured to fix the noise reducing member to a position spaced from the fan unit, may protrude from each of the first and second communication members.

In an embodiment of the present disclosure, a coupling member may be coupled to the coupling boss via a coupling hole of the noise reducing member.

In an embodiment of the present disclosure, the noise reducing member may include: a base part mounted to the first and second communication members; and an extending part downward extending from the base part in a bent manner, and disposed to cover a rear upper side of the fan unit.

In an embodiment of the present disclosure, the noise reducing member may be formed to have a rounded shape corresponding to appearance of the fan unit, so as to cover at least part of the fan unit.

In an embodiment of the present disclosure, the robot cleaner may further include a supporting unit disposed between an inner bottom surface of the cleaner body and the fan unit, configured to support the fan unit, and formed of an elastic material so as to absorb vibrations generated from the fan unit. The supporting unit may include: a motor supporting member installed on an inner bottom surface of the cleaner body, and formed to enclose at least part of the motor part; and first and second fan supporting members disposed at two sides of the motor supporting member, and configured to support the first and second fan parts.

In an embodiment of the present disclosure, the motor supporting member may include: a base part installed on an inner bottom surface of the cleaner body; and an extending part upward extending from the base part, and having an inner side formed to correspond to an outer circumference of the motor part so as to enclose at least part of the motor part.

In an embodiment of the present disclosure, the motor part may include: a motor; and a first motor housing and a second motor housing coupled to each other to accommodate the motor therein, each motor housing provided with a plurality of ribs protruding from an outer circumference thereof. The ribs of one of the first and second motor housings may be provided with protrusions, and the ribs of another of the first and second motor housings may be provided with accommodation grooves for accommodating the protrusions therein.

In an embodiment of the present disclosure, a hollow part may be formed between the base part and the extending part, thereby reducing vibrations from being transmitted to the base part from the extending part.

In an embodiment of the present disclosure, coupling holes may be formed at the motor supporting member, and coupling members may be coupled to the inner bottom surface of the cleaner body through the coupling holes, thereby fixing the motor supporting member to the cleaner body.

In an embodiment of the present disclosure, the first and second fan parts may include: first and second fans rotated by driving of the motor; and first and second fan covers configured to accommodate the first and second fans therein, and having protruding parts formed to face the inner bottom surface of the cleaner body. And the first and second fan supporting members may be disposed between the inner bottom surface of the cleaner body and the protruding parts.

In an embodiment of the present disclosure, a protrusion may be formed to protrude from the protruding part, toward an inner bottom surface of the cleaner body. And an insertion groove configured to insert the protrusion therein may be formed at each of the first and second fan supporting members.

In an embodiment of the present disclosure, the fan unit may further include: a first communication member configured to connect the first fan part with a first cyclone of the cyclone unit; and a second communication member configured to connect a second fan part with the second cyclone of the cyclone unit; a first connection member disposed between the first fan part and the first communication member, and formed of an elastic material so as to absorb vibrations generated from the first fan part; and a second connection member disposed between the second fan part and the second communication member, and formed of an elastic material so as to absorb vibrations generated from the second fan part.

In an embodiment of the present disclosure, the first connection member may be formed to have a ring shape so as to enclose a first air inlet provided on a rotation shaft of the first fan, and the second connection member may be formed to have a ring shape so as to enclose a second air inlet provided on a rotation shaft of the second fan.

In an embodiment of the present disclosure, the cyclone unit may be coupled to the fan unit, and may be spaced apart from an inner bottom surface of the cleaner body.

In an embodiment of the present disclosure, the robot cleaner may further include a dust box communicated with a dust discharge opening formed in front of the cyclone unit so as to collect dust separated from the cyclone unit, the dust box formed such that at least part thereof is accommodated between the first and second guiding members.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner, comprising:

a cleaner body;

a suction module provided in the cleaner body, and configured to suck dust on a surface to be cleaned;

a first guiding member and a second guiding member communicated with the suction unit, and spaced apart from each other;

a cyclone module configured to separate dust from air sucked through the first and second guiding members;

a fan module connected to the cyclone module, and including a motor module, and a first fan module and a second fan module connected to two sides of the motor module and configured to generate a suction force; and a noise reducing cover provided over an upper side of the fan module so as to reduce noise, and extending toward two sides of the motor module to cover the first and second fan modules.

2. The robot cleaner of claim 1, wherein a noise absorbent configured to absorb at least part of noise is attached to an inner side of the noise reducing cover, the inner side facing the fan module.

3. The robot cleaner of claim 2, wherein the noise absorbent is a sponge.

4. The robot cleaner of claim 1, wherein the cyclone module is connected to a front upper side of the fan unit, and wherein the noise reducing member is installed at the fan unit so as to cover a rear upper side of the fan unit.

5. The robot cleaner of claim 1, wherein the fan module further includes:

a first communication member configured to communicate the first fan module with a first cyclone provided at the cyclone module; and a second communication member configured to communicate the second fan module with a second cyclone provided at the cyclone module, and first and second elastic rings mounted in the first and second communication members, respectively.

6. The robot cleaner of claim 5, wherein a coupling boss, configured to fix the noise reducing cover to a position spaced from the fan unit, protrudes from each of the first and second communication members.

7. The robot cleaner of claim 6, wherein a fastener is coupled to the coupling boss via a coupling hole of the noise reducing cover.

8. The robot cleaner of claim 5, wherein the noise reducing member includes:

a base plate mounted to the first and second communication members; and an extending plate downward extending from the base plate in a bent manner, and disposed to cover a rear upper side of the fan module.

9. The robot cleaner of claim 1, wherein the noise reducing cover has a contour corresponding to appearance of the fan unit so as to cover at least part of the fan module.

10. The robot cleaner of claim 1, further comprising a support provided between an inner bottom surface of the cleaner body and the fan unit, configured to support the fan module, and formed of an elastic material so as to absorb vibrations generated from the fan module, wherein the support includes:

a motor support provided on an inner bottom surface of the cleaner body, and formed to enclose at least part of the motor module; and first and second fan supports provided at two sides of the motor support, and configured to support the first and second fan modules, respectively.

11. The robot cleaner of claim 10, wherein the motor support includes:

a base provided on an inner bottom surface of the cleaner body; and an extension part upward extending from the base, and having an inner contour to correspond to an outer circumference of the motor module so as to enclose at least part of the motor module.

12. The robot cleaner of claim 11, wherein the motor includes:

a motor; and a first motor housing and a second motor housing coupled to each other to accommodate the motor therein, each motor housing provided with a plurality of ribs protruding from an outer circumference thereof, wherein the ribs of one of the first motor housing are provided with protrusions, and wherein the ribs of the second motor housing is provided with accommodation grooves for accommodating the protrusions therein.

13. The robot cleaner of claim 11, wherein at least one opening is formed between the base and the extension to reduce vibrations from being transmitted to the base from the extension.

14. The robot cleaner of claim 10, wherein coupling holes are formed at the motor support, and wherein fasteners are coupled to the inner bottom surface of the cleaner body through the coupling holes to attach the motor support to the cleaner body.

15. The robot cleaner of claim 10, wherein the first and second fan modules include:

first and second fans configured to be rotated by the motor; and first and second fan covers configured to accommodate the first and second fans therein, and having first and second protrusions, respectively, formed to face the inner bottom surface of the cleaner body, and wherein the first and second fan supports are provided between the inner bottom surface of the cleaner body and the first and second protrusions.

16. The robot cleaner of claim 15, wherein a vertical protrusion is formed to protrude from each of the first and second protrusions, toward the inner bottom surface of the cleaner body, and wherein an insertion groove configured to receive the vertical protrusion therein is formed at each of the first and second fan supports.

17. The robot cleaner of claim 10, wherein the fan module further includes:

a first communication member configured to connect the first fan module with a first cyclone of the cyclone module; and a second communication member configured to connect the second fan module with a second cyclone of the cyclone module;

a first elastic ring disposed between the first fan module and the first communication member, and configured to absorb vibrations generated from the first fan module; and a second elastic ring disposed between the second fan module and the second communication member, and configured to absorb vibrations generated from the second fan module.

18. The robot cleaner of claim 17, wherein the first connection member is formed to have a ring shape so as to enclose a first air inlet provided on a rotation shaft of the first fan, and wherein the second connection member is formed to have a ring shape so as to enclose a second air inlet provided on a rotation shaft of the second fan.

19. The robot cleaner of claim 1, wherein the cyclone module is coupled to the fan module, and is spaced apart from an inner bottom surface of the cleaner body.

20. The robot cleaner of claim 1, further comprising a dust box coupled through a dust discharge opening formed in front of the cyclone module so as to collect dust separated from the cyclone module, at least part of the dust box is accommodated between the first and second guiding members.

* * * * *